US007574877B1

(12) United States Patent
Calissoni

(10) Patent No.: US 7,574,877 B1
(45) Date of Patent: Aug. 18, 2009

(54) PROCEDURE FOR MANUFACTURING LADDERPROOF FABRICS

(75) Inventor: Laura Calissoni, Aicurzio (IT)

(73) Assignee: Carvico S.p.A., Carvico (Bergamo) (IT)

( * ) Notice: Subject to any disclaimer, the term of this patent is extended or adjusted under 35 U.S.C. 154(b) by 0 days.

(21) Appl. No.: 12/177,140

(22) Filed: Jul. 21, 2008

(30) Foreign Application Priority Data

Jul. 20, 2007 (EP) ..... 07425448

(51) Int. Cl.
*D04B 27/02* (2006.01)

(52) U.S. Cl. ..... 66/214; 66/125 R

(58) Field of Classification Search ..... 66/135 R, 66/126 R, 136, 137, 214, 178 R, 179, 180, 66/181, 182, 183, 184, 185
See application file for complete search history.

(56) References Cited

U.S. PATENT DOCUMENTS 464,995 A * 12/1891 Roberts ..... 66/141
2,418,445 A * 4/1947 Amidon ..... 66/214
3,541,813 A * 11/1970 Schubert et al. ..... 66/214
3,757,537 A * 9/1973 York ..... 66/9 R
3,837,183 A 9/1974 Kohl
4,137,734 A * 2/1979 Kohl ..... 66/214
4,998,418 A * 3/1991 Fatigati ..... 66/14
6,370,922 B1 * 4/2002 Brach et al. ..... 66/136
7,032,626 B2 * 4/2006 Glenn et al. ..... 139/426 R

FOREIGN PATENT DOCUMENTS

DE 1076305 B 2/1960
DE 2805847 A1 8/1978

* cited by examiner

*Primary Examiner*—Danny Worrell
(74) *Attorney, Agent, or Firm*—Browdy and Neimark, P.L.L.C.

(57) ABSTRACT

A procedure for manufacturing ladderproof fabrics on a warp knitting machine (1) comprising stitch-forming members (4) and at least one guide bar (2), with a plurality of guides (2*a*) for guiding a plurality of yarns (10) towards the stitch-forming members (4), wherein each of the guides (2*a*) belonging to at least one of the guide bars (2) guides a plurality of yarns (10).

15 Claims, 4 Drawing Sheets

*known art*

PROCEDURE FOR MANUFACTURING LADDERPROOF FABRICS

FIELD OF THE INVENTION

The present invention relates to a procedure for manufacturing ladderproof fabrics on a warp knitting machine, comprising stitch-forming members and at least one guide bar, with a plurality of guides, comprising at least one eyelet, for guiding a plurality of yarns in the direction of said stitch-forming members, and a fabric obtained by means of said procedure.

DESCRIPTION OF THE PRIOR ART

It is common knowledge that fabrics are made of a plurality of yarns placed in particular recurrent arrangements that enable said yarns to be linked together to form stitches.

The characteristics of fabrics are thus determined by the arrangement of the yarns in the pattern, the type of yarn used and, finally, the dimensions of the single stitches.

In particular, the so-called ladderproof elastic fabrics are made using a basic pattern comprising a plurality of yarns running in the same direction, called the warp, with a combination of substantially inelastic and substantially elastic yarns.

Ladderproof elastic fabrics are used in various applications and particularly for items of clothing such as swimming costumes, sportswear, underwear and so on.

The fabrics in question are manufactured industrially by specific warp knitting machines that comprise means for delivering and handling the yarns, which are inserted through the eyelet of specific perforated members, called guides, and dropped onto a row of needles lying crosswise to the direction of the yarns.

Said needles and guides are also placed in a recurrent arrangement along specific bars that extend in a longitudinal direction.

In particular, a plurality of guide bars are provided, one for each different yarn forming the basic pattern, and one bar of needles and other stitch-forming members, each of which serves a different purpose.

More in detail, each yarn in the basic pattern passes through the eyelet of a different guide and the yarns subsequently interact simultaneously with the underlying needles.

A schematic example of a cross-sectional view of a known knitting machine, with the type of loom used for making ladderproof fabrics, is shown in FIG. 1, where two separate, substantially identical guide bars each convey a yarn to three needle bars underneath that carry the stitch-forming members that interact with one another to create the fabric.

When these machines are started, the guides and the needles perform reciprocating movements, while the yarns travel with a continuous movement. In particular, the yarns have a continuous, vertical and descending movement, while the guides that subsequently move the yarns further have a longitudinal and crosswise reciprocating movement.

The needles situated underneath the guides that interact with the yarns moved by the guides are operated with a vertical reciprocating movement. Among the fabrics made using machines of this kind, a fabric has recently been developed by the Applicant consisting of a basic pattern with a plurality of yarns, and two yarns in particular, arranged substantially parallel to one another.

In this type of fabric, the basic pattern contains both elastic yarns, consisting of elastomers such as lycra or the like, and inelastic yarns, consisting of polyamides or the like.

These fabrics have excellent characteristics of high strength and limited thickness.

Being difficult to dye and unattractive, the elastic yarns in such fabrics are hidden by the inelastic yarns.

It has been demonstrated, however, that the elastic yarns sometimes do not remain aligned behind the inelastic yarns and they emerge on the surface, with a negative fallout on the appearance and feel of the fabric.

It is also worth noting that yarns with a very fine titre cause a reduction in the productivity of knitting machines and a consequent increase in the cost of manufacturing the related fabrics.

SUMMARY OF THE INVENTION

In this light, the technical aim lying behind the present invention is to design a ladderproof elastic fabric capable of substantially overcoming the above-described drawbacks.

Within the context of said technical aim, a major object of the invention is to realise a procedure for manufacturing ladderproof fabrics, and particularly suitable for making fabrics comprisinn a basic pattern with yarns arranged parallel to one another, that have an improved appearance and surface feel. Another object of the invention is to realise a procedure for manufacturing ladderproof fabrics with a high rate of productivity.

The technical aim and objects specified above are achieved by a ladderproof elastic fabric realized on a warp knitting machine comprising stitch-forming members and at least one guide bar, with a plurality of guides, comprising at least one eyelet, for guiding a plurality of yarns in the direction of said stitch-forming members by means of procedure in that each of said guides belonging to at least one of said guide bars guides a plurality of yarns by means of said eyelet. The said fabrics have considerably improved characteristics in terms of appearance and feel.

BRIEF DESCRIPTION OF THE DRAWINGS

Additional characteristics and advantages of the invention are better explained below in a detailed description of preferred embodiments of the invention, with reference to the attached drawings, wherein.

DESCRIPTION OF THE PREFERRED EMBODIMENTS

With reference to the attached figures, the knitting machine for implementing the procedure according to the invention is globally indicated by the numeral 1.

Figure 1:
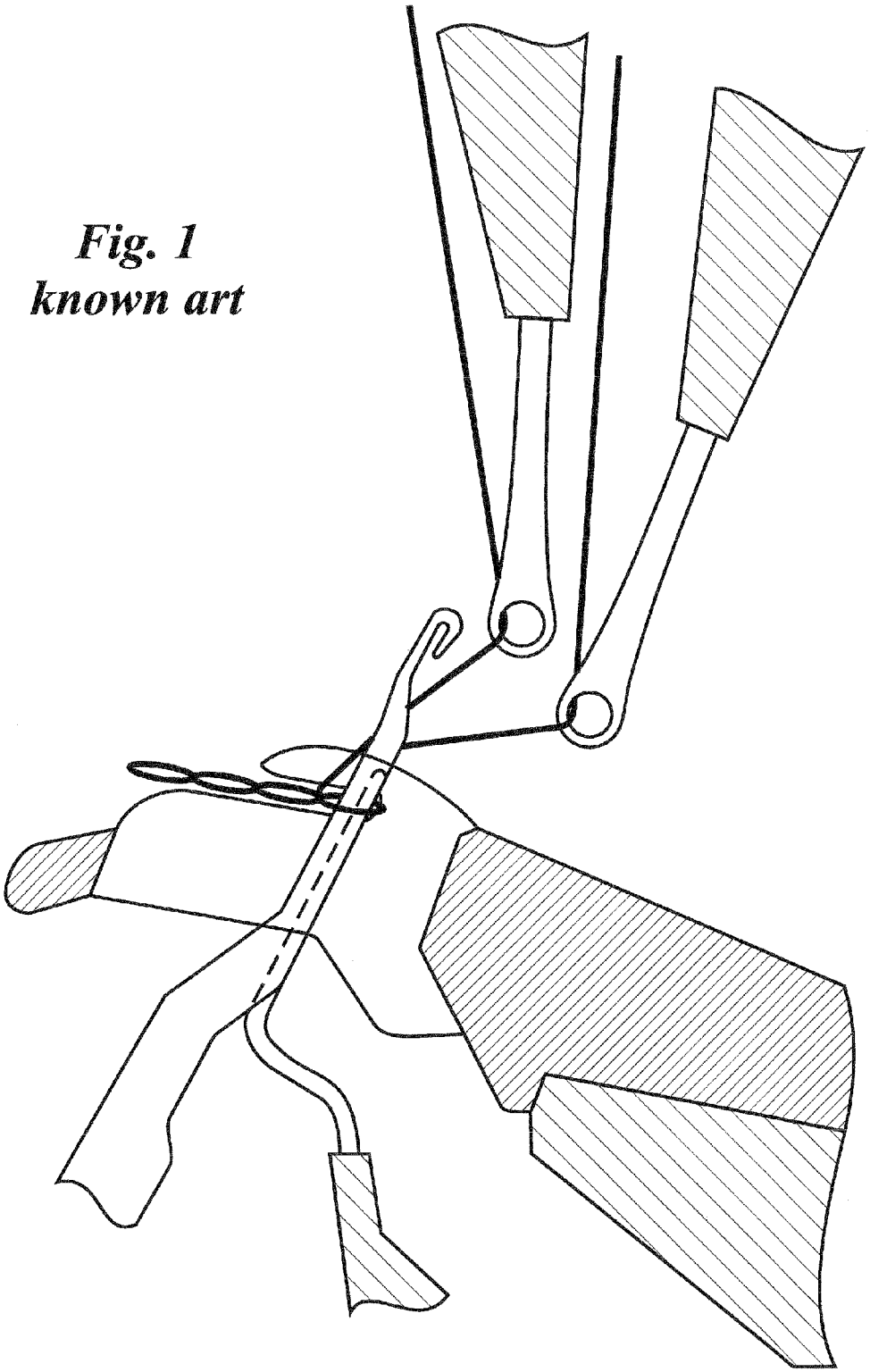
FIG. 1 shows a cross-sectional view of the main portion of a knitting machine according to the known state of the art.

It substantially and preferably comprises a loom of the single needle bed, ladderproof type, shown in FIG. 1.

These machines are partially known and are supplied, for instance, by the German company LIBA Maschinenfabrik GmbH, going by the name of Copcentra.

The warp knitting machine 1 comprises at least one guide bar 2, a system of stitch-forming members 3, and a yarn conveyor system 5.

Figure 2A:
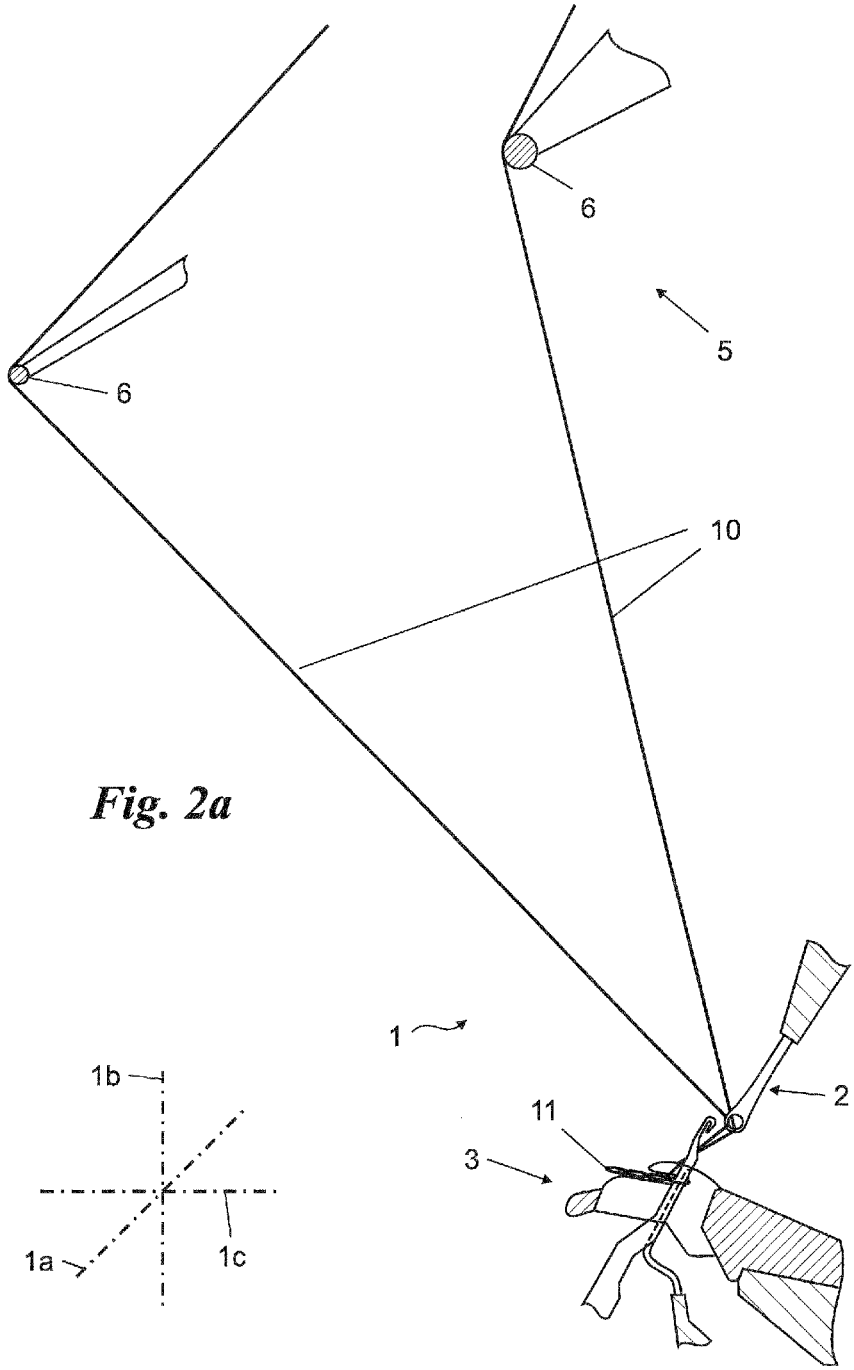
FIG. 2*a* shows a cross-sectional view of the main portion of a knitting machine for implementing the procedure according to the invention.
Figure 2B:
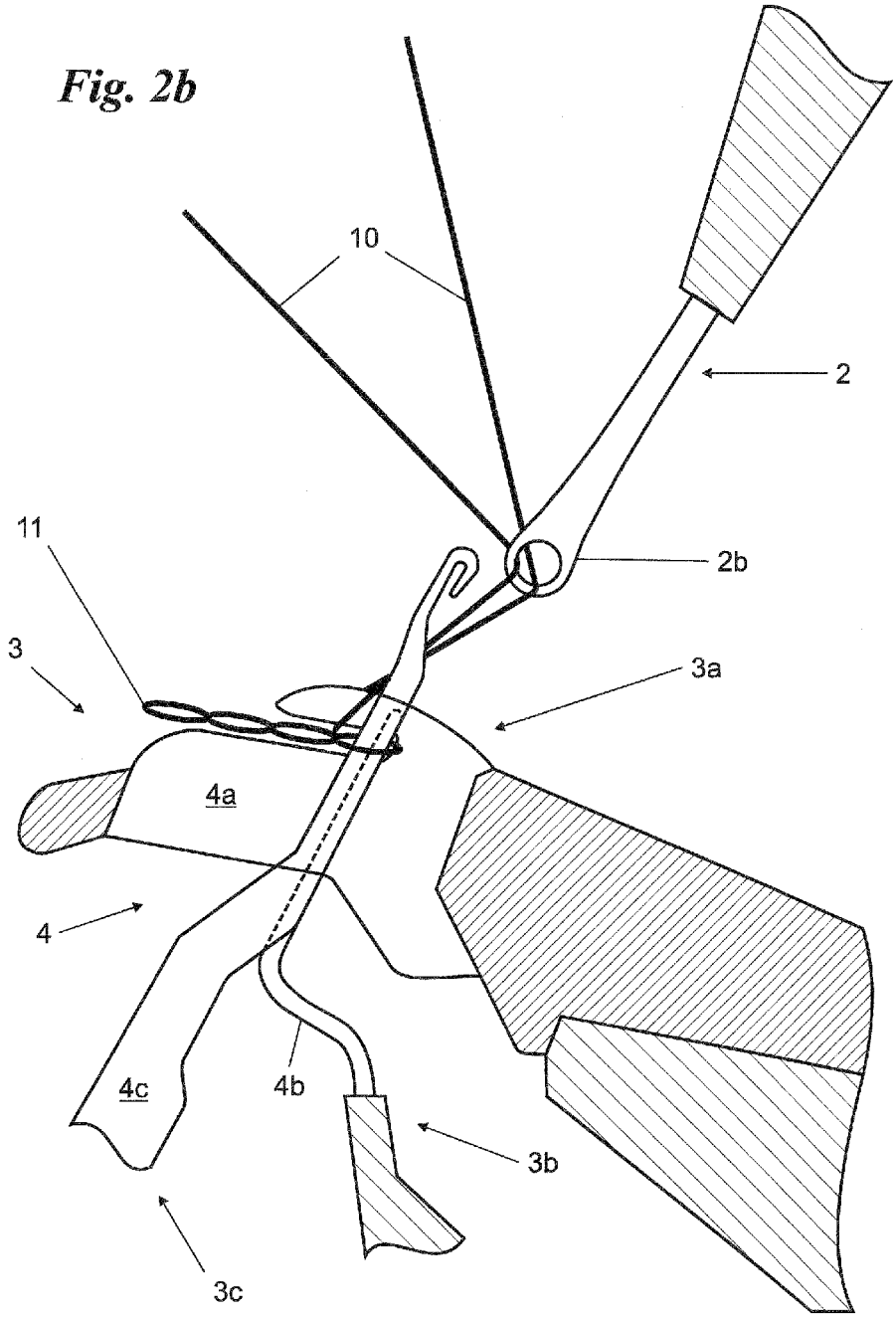
FIG. 2*b* shows an enlargement of the cross-sectional view of the main portion of a knitting machine suitable for implementing the procedure according to the invention, shown in FIG. 2*a;*

In particular, each guide bar 2 comprises a plurality of guides 2*a* in a recurrent arrangement and parallel to one another in the longitudinal direction 1*a*, perpendicular to the plane of the cross-section shown in FIG. 2*a*, and to the vertical 1*b* and crosswise 1*c* directions.

The system of stitch-forming members 3 is of the known type and basically comprises a sinker bar 3*a*, a slider bar 3*b* and a needle bar 3*c* suitable for engaging, entraining and linking the yarns according to a known procedure.

In particular, the system of stitch-forming members 3 comprises a plurality of single stitch-forming members 4, and each bar of sinkers 3*a*, sliders 3*b* and needles 3*c* of the system of stitch-forming members 3 respectively comprises a plurality of single sinkers 4*a*, sliders 4*b* and needles 4*c* in a recurrent arrangement and parallel to one another in the longitudinal direction 1*a*, and with the same spatial arrangement as the guide bars 2.

Said guide bars 2 and stitch-forming members 4 also perform predetermined recurrent movements.

The procedure according to the invention involves a plurality of yarns 10 being placed on the conveyor system 5 and particularly on suitable rollers or reels.

As they unwind, these rollers enable the forward feed of the yarns 10, their passage over specific tension rods 6 and a continuous supply of yarn to the guides 2*a* and stitch-forming members 4.

The conveyor system 5, and particularly the tension rods 6, are thus able to determine the angle of inclination, in relation to the vertical direction 1*b*, with which the yarns 10 reach the guides 2*a*.

By means of the previously-described recurrent movement, the latter link the yarns 10 to one another and thus create a ladderproof fabric 11.

The procedure according to the invention entails each guide 2*a*, belonging to at least one guide bar 2, guiding a plurality of yarns 10, and preferably two yarns 10.

In particular, each guide 2*a* comprises an eyelet 2*b*, through which a plurality of yarns 10, and preferably two yarns 10, passes in order to be guided towards the stitch-forming members 4.

Said eyelet 2*b* for the passage of several yarns 10 preferably has a hole 2*d* the maximum dimensions of which are greater than 1 mm and preferably approximately 2 mm.

In particular, the eyelet 2*b* is preferably a hole that is substantially circular and has a diameter coming between 1 mm and 2 mm.

Alternatively, there may be several eyelets 2*b* in each guide 2*a*, preferably one for each yarn 10, or the eyelets 2*b* may not be circular, but of a shape, such as an oval, suitable for enabling the passage of several yarns 10.

Obviously, there may be several guide bars 2 with guides 2*a*, each of which guides a plurality of yarns 10, or there may be guide bars 2 with guides 2*a*, each guiding a plurality of yarns 10, associated with guide bars 2 with guides 2*a* that each guide only one yarn 10, or other solutions may be used. There is preferably only one guide bar 2 (or only one is used), the guides 2*a* of which guide two yarns 10 and particularly one elastic yarn 10*a* and one inelastic yarn 10*b*, as described in more detail below.

Moreover, the conveyor system 5 suitably guides the two yarns 10 in different forward feed directions 6*a* that preferably form an angle of intersection, a coming between 10° and 60° or, better still, between 20° and 40°.

Figure 2C:
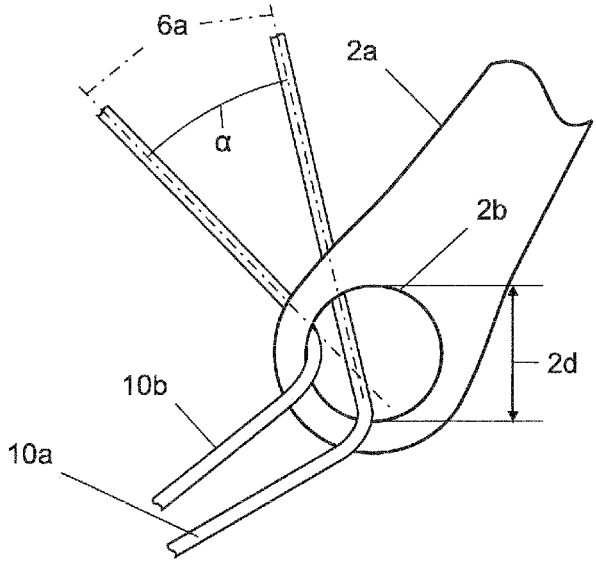
FIG. 2*c* shows a further enlargement of the cross-sectional view of the main portion of a knitting machine suitable for implementing the procedure according to the invention, illustrated in FIGS. 2*a* and 2*b;*

Said different forward feed directions 6*a* are designed to ensure that the two different yarns 10 do not interfere with one another in line with the eyelet 2*b*, as shown in FIG. 2*c*.

As a consequence, there are preferably two tension rods 6, one to the rear carrying the elastic yarn 10*a*, and one to the front carrying the inelastic yarn 10*b*.

Herein, a yarn is defined as substantially inelastic if its maximum elastic elongation is less than 20% of its total length, while a yarn is defined as elastic if it has a maximum elongation in excess of 80% of its total length. Using the proposed solution, each guide bar 2 can be fed with two yarns 10 travelling at a different rate, defined by the rate at which they unwind from the conveyor system 5.

In fact, it is often necessary to use a different tension and stretch (or axial elongation) for the elastic and inelastic yarns 10, and consequently to unwind and feed said yarns 10 forward at different rates.

Moreover, the density of guides 2*a* per inch (1 inch=2.54 cm), in the longitudinal direction 1*a*, preferably comes between 32 and 44 or, better still, between 40 and 44.

The fabric 11 is thus defined by a basic pattern 12, that recurs at regular intervals in the fabric 11.

Said basic pattern 12 comprises at least two yarns 10 and involves said at least two yarns 10 lying parallel to one another.

Said two yarns 10 are guided by a single guide 2*a* and thus travel along the same path, always remaining parallel to one another and close together, side by side.

In particular, there are only two yarns 10 in the basic pattern 12, i.e. the elastic yarn 10*a* and the inelastic yarn 10*b*.

The inelastic yarn 10*b* is made of a material of known type: for instance, this may be a multifilament polyamide yarn, or it may be made of polyester, polypropylene or other such materials.

It preferably has a titre coming between 22 and 60 dTex or, better still, between 22 and 44 dTex. It is common knowledge that dTex measures the titre, or linear density, of a yarn and is expressed in grams per 10 kilometers (1 dTex=0.1 g/km).

The elastic yarn 10*a* is made of an elastic material of known type, and particularly of an elastomeric polymer or Lycra®. It preferably has a titre coming between 22 and 60 dTex.

The yarns 10 are arranged in certain patterns determined by the reciprocating movement of the guide bars 2.

Figure 3:
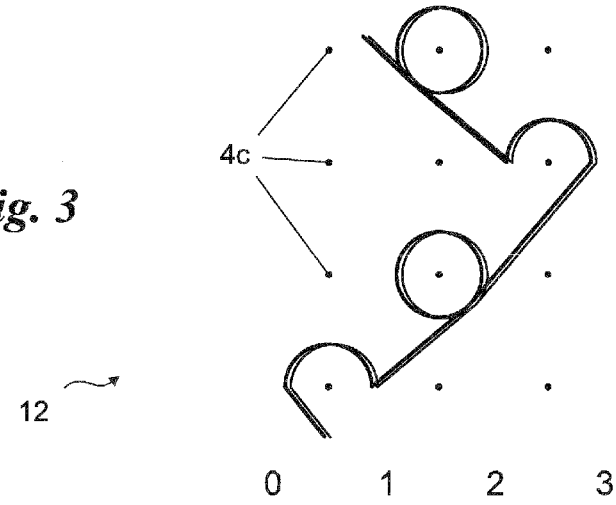
FIG. 3 shows the basic pattern of a fabric that can be manufactured using the procedure according to the invention.

For example, FIG. 3 schematically shows the preferred basic pattern 12 for manufacturing the fabric 11 according to the procedure of the invention.

The figure shows a plurality of dots, each of which represents a needle 4*c* of the first needle bar 3*c* in one of its temporary positions. The needles 4*c* are arranged in horizontal lines, called courses, and in vertical lines, called rows. The rows are actually defined by the recurrent movements of the yarns and needles, while the courses are defined by the horizontal position of said needles. So a row of needles represents the recurrent positioning of the same needle, while each course represents a plurality of different needles.

The white spaces between the rows are numbered using natural numbers from zero to four and represent the positions in which the guides 2*a* place the yarns.

In particular, the two yarns 10*a* and 10*b* are both arranged according to a basic pattern 12 that is repeated every four stitches, in which three consecutive stitches are obtained on different needles 4*c*. The term consecutive is used here to mean that no needles 4*c* are skipped.

Said type of pattern is technically known as a four-stitch "Atlas" knit.

Said pattern can comprise closed or open stitches: in particular, of the four stitches involved, the closed stitches can vary in number from zero to four, while the remainder will be open.

FIG. 3 shows a pattern in which there are closed stitches alternating with open stitches and, in particular, the open stitches are placed on the two outer needles of the set of three needles 4*c*.

Said pattern 12 is defined by a movement of the guide bar 2 in line with the spaces from 0 to 1 in a first course, from 2 to 1 in a second course, from 3 to 2 in a third course and from 1 to 2 in the fourth course.

The invention achieves important advantages.

In fact, it has been demonstrated that fabrics 11 made using the procedure according to the invention have considerably improved characteristics in terms of appearance and feel by comparison with the same types of fabric 11 achieved with an identical basic pattern 12 but using a procedure of the known type, i.e. a procedure that involves each yarn passing through the eyelet of a different guide belonging to a different guide bar.

The above-stated advantage is due in particular to the fact that the yarns 10, guided by a single guide 2*a*, always remain juxtaposed and consequently remain arranged in the order established by the knitting machine 1, without the underlying yarn, i.e. the elastic yarn 10*a*, emerging on the surface of the fabric 11.

It has also been demonstrated that, for the same reason, the surface texture of the fabric 11*a* improves considerably.

These improvements have been verified particularly in fabrics made using a four-stitch Atlas knit pattern and two yarns, one elastic 10*a* and the other inelastic 10*b*. Because of its fine titre and complexity, such a fabric 11 is particularly improved by the technical solution that involves inserting the two yarns in a single eyelet 2*b* in a guide 2*a*.

Another advantage stems from the fact that the need to move only one guide bar 2 has enabled an improvement in the productivity of the machine 1 and a consequent reduction of the cost of the fabric 11.

The invention claimed is:

1. A method for manufacturing ladderproof fabrics on a warp knitting machine (1), the knitting machine (1) comprising:

stitch-forming members (4); and at least one guide bar (2) having a plurality of guides (2*a*), wherein one of the plurality guides comprising at least one eyelet (2*b*), each of the at least one eyelet guiding a plurality of yarns (10) in a direction of said stitch-forming members (4);

the method comprising: guiding a plurality of yarns (10) in each of said at least one eyelet (2*b*), and feeding a first yarn (10*a*) and a second yarn (10*b*) of said plurality of yarns (10) to said at least one eyelet (2*b*) in predetermined forward feed directions, respectively, wherein a difference (6*a*) of said predetermined forward feed directions ensures said first and second yarns (10*a*, 10*b*) do not interfere with one another.

2. The method according to claim 1, wherein each of the plurality of guides (2*a*) comprises a single eyelet (2*b*).

3. The method according to claim 1, wherein each of the plurality of guides (2*a*) guides two yarns (10).

4. The method according to claim 3, wherein each of the plurality of guides (2*a*) guides an elastic yarn (10*a*) and an inelastic yarn (10*b*).

5. The method according to claim 4, wherein said inelastic yarn (10*b*) has a linear density between 22 and 44 dTex and said elastic yarn (10*a*) has a linear density between 33 and 44 dTex.

6. The method according to claim 5, wherein said plurality of guides (2*a*) is placed on said at least one guide bar (2) so that there are between 40 and 44 guides per inch.

7. The method according to claim 5, wherein said yarns (10) are arranged in a four-stitch Atlas knit pattern.

8. The method according to claim 1, wherein said knitting machine (1) further comprises a conveyor system (5) that makes the yarns (10) move in said predetermined forward feed directions (6*a*) so that said difference (6*a*) of said predetermined forward feed directions form an angle of intersection ($\alpha$) between 10° and 60°.

9. The method according to claim 8, wherein said conveyor system (5) feeds the different yarns (10) forward at different speeds.

10. The method according to claim 1, wherein the first yarn (10*a*) is an elastic yarn (10*a*) and the second yarn (10*b*) is an inelastic yarn.

11. The method according to claim 10, further comprising: feeding said elastic yarn (10*a*) and inelastic yarn (10*b*) at different speeds.

12. The method according to claim 1, wherein said difference (6*a*) of said predetermined forward feed directions is between 10° and 60°.

13. A warp knitting machine (1), the knitting machine (1) comprising:

a stitch-forming member (4);

at least one guide bar (2) having a plurality of guides (2*a*), wherein one of the plurality guides comprising an eyelet (2*b*), guiding a first yarn (10*a*) and a second yarn (10*b*) to said stitch-forming members (4);

a conveyor system (5) feeding the first and second yarns (10*a*, 10*b*) in predetermined different forward feed directions (6*a*), so that the first and second yarns (10*a*, 10*b*) have an angle of intersection ($\alpha$) between 10° and 60°.

14. The warp knitting machine according to claim 13, wherein each guide (2*a*) comprises a single eyelet (2*b*).

15. The warp knitting machine according to claim 14, wherein said plurality of guides (2*a*) are placed on said guide bar (2) so that there are between 40 and 44 guides per inch.

* * * * *